United States Patent [19]

McLaren

[11] Patent Number: 4,715,506

[45] Date of Patent: Dec. 29, 1987

[54] TAMPER RESISTANT CLOSURES

[75] Inventor: Kevin W. McLaren, Erith, England

[73] Assignee: Johnsen & Jorgensen Plastics Limited, London, England

[21] Appl. No.: 903,556

[22] Filed: Sep. 4, 1986

[30] Foreign Application Priority Data

Oct. 15, 1985 [GB] United Kingdom ..... 8525351

[51] Int. Cl.[4] ..... B65D 41/34

[52] U.S. Cl. ..... 215/252

[58] Field of Search ..... 215/252

[56] References Cited

U.S. PATENT DOCUMENTS 4,147,268 4/1979 Patel et al. ..... 215/252
4,299,328 11/1981 Ochs et al. ..... 215/252
4,322,012 3/1982 Conti ..... 215/252 X
4,461,391 7/1984 Davis ..... 215/252
4,579,241 4/1986 Hayes ..... 215/252

*Primary Examiner*—Donald F. Norton
*Attorney, Agent, or Firm*—Wood, Dalton, Phillips, Mason & Rowe

[57] ABSTRACT

A container closure and container body assembly in which the container body has a mouth and an external annular or substantially annular projecting bead around the outside of the body below the mouth and in which the closure comprises a cap part and a tamper resistant band connected to the cap part by frangible means in which the tamper resistant band is provided with a plurality of spaced apart individual lugs on the inner surface of the band to co-operate with the external projecting bead around the outside of the container body.

9 Claims, 6 Drawing Figures

TAMPER RESISTANT CLOSURES

This invention is concerned with the provision of an improved tamper-resistant container body and closure assembly. The invention also provides an improved closure for application to a container body. It has already been proposed to provide a tamper-resistant container body and closure assembly in which the container body has a mouth and an external projecting bead around the outside of the body below the mouth in which the closure comprises a cap part and a tamper resistant band connected to the cap part by frangible means and provided with an internal annular bead around the inside of the band. With an assembly as described above the internal annular bead on the band snaps over the external annular bead on the body when the closure is first applied to the body and the internal bead then settles into position below the external bead so that the closure cannot be removed from the body to open the mouth until the band is torn away leaving the cap part free for removal.

An arrangement as described above in general works very well but we have found that the moulding tolerances are sometimes unduly exacting in the sense that if one or both beads is/are oversize difficulty may be experienced in applying closure to the body without breaking the frangible means connecting the cap part to the band. On the other hand if one or both beads is/are undersize it may be possible to remove the cap part without first tearing away the band.

In accordance with this invention we overcome the difficulty set forth above by providing the closure with a plurality of spaced apart individual lugs instead of providing a complete annular bead encircling the inside of the band. Our experiments have indicated that by providing lugs spaced apart around the band it is possible for the band not only to expand as it passes over the bead on the body but as the lugs pass over the bead the band momentarily looses its circular formation in a reshaping adjustment that enables the band more easily to be snapped into position thus enabling lugs to be used that project inwardly to a slightly greater extent than in the case of a bead. The use of spaced apart lugs also makes it possible to mould at least some of the lugs with a sharper and therefore a more positive profile than when we are moulding an annular bead.

The spaced apart lugs may all be of the same arcuate size and shape or some may be longer and sharper than others.

In order that the invention may be more clearly understood reference is now directed, by way of example, to the accompanying drawings in which.

Figure 1:
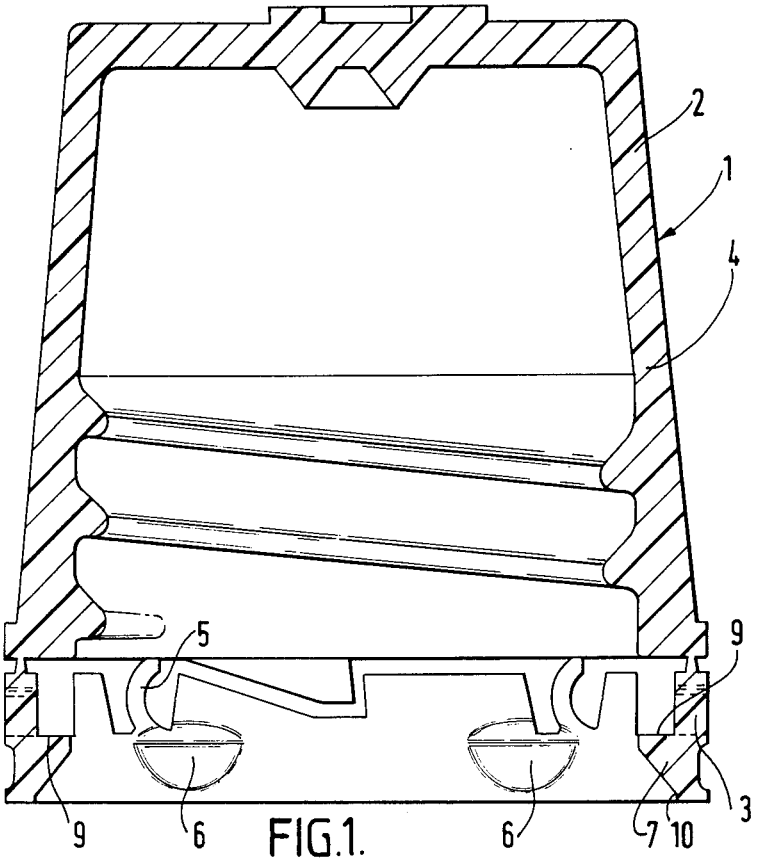
FIG. 1 is a longitudinal sectional view on the line A—A of FIG. 3 of a closure in accordance with the invention.
Figure 2:
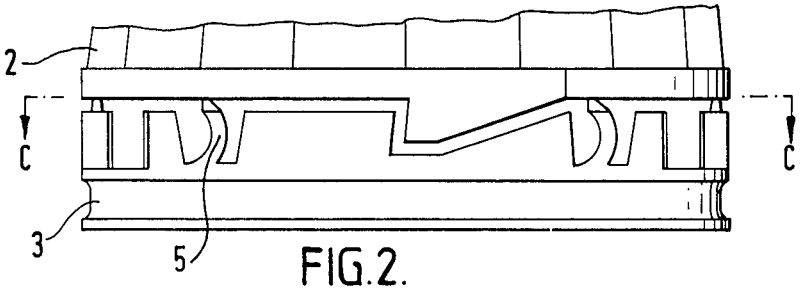
FIG. 2 is a detail side view.
Figure 3:
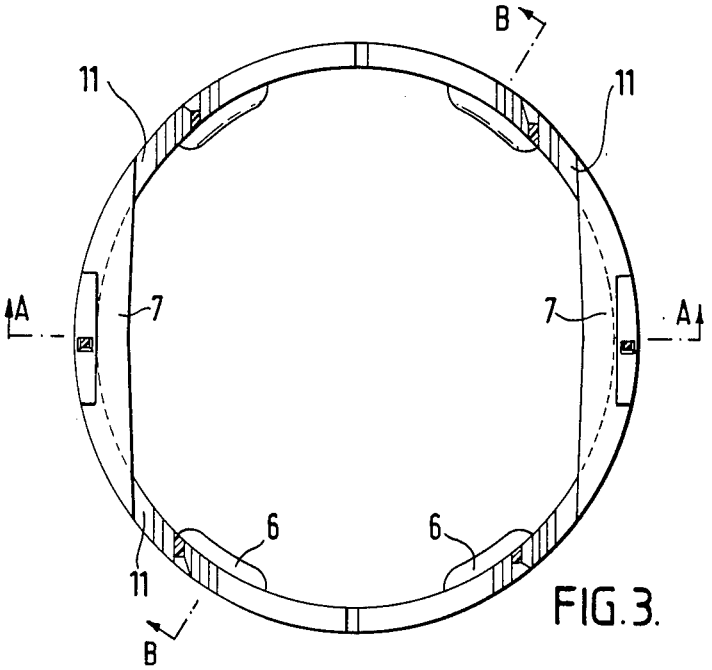
FIG. 3 is a plan view across the line C—C of FIG. 2.

Referring now to the drawings general details of the closure illustrated are described fully in our European Patent Application No. 82306203 and further details of that application will be given later in this specification.

The closure 1 in accordance with this invention has a cap part 2 and a tamper resistance band 3 connected to the skirt 4 of the cap part 3 by frangible tongues 5.

Figure 4:
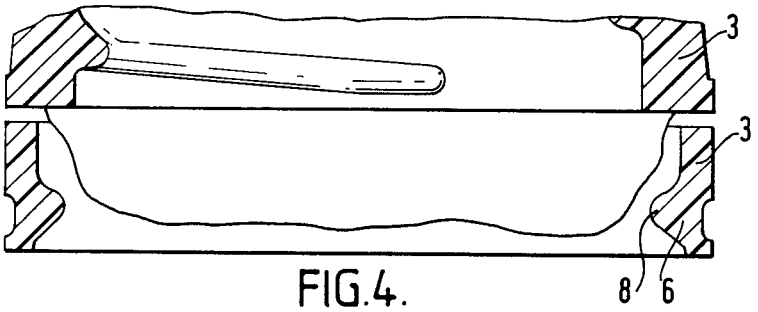
FIG. 4 is a section on the line B—B of FIG. 3.

In accordance with this invention the band 3 has a plurality, in this case four, of small lugs 6 and a plurality, in this case two, of large lugs 7. The small lugs 6 are rounded in profile at 8, see e.g., section on line B—B in FIG. 4 to facilitate snapping on of the closure 1. In contrast the large lugs 7 have a sharper profile with a substantially horizontal upper surface 9 and an inclined lower cam surface 10 to facilitate snapping on of the closure 1. It will be understood that when the lugs 7 are in position under the annular bead on the container body the surface 9 very positively holds the band 3 in position.

Figure 5:
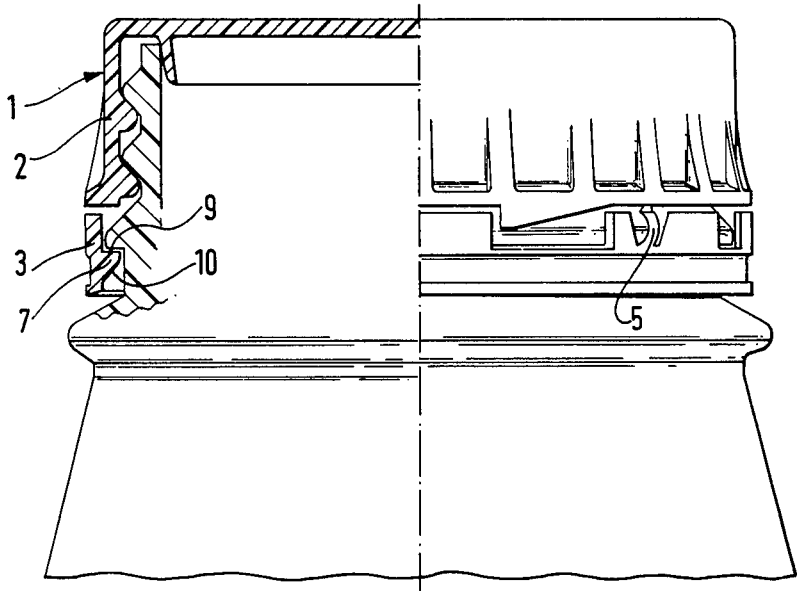
FIG. 5 is a part section, part elevation of a closure similar to that shown in FIG. 1 applied to a milk bottle.
Figure 6:
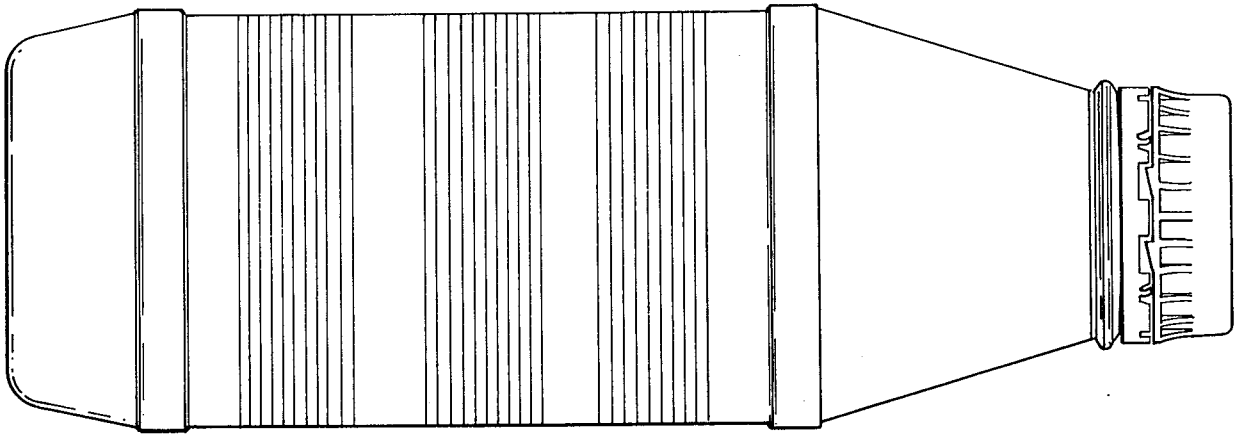
FIG. 6 is a side view of a milk bottle and closure assembly according to the invention.

Moulding of the large lugs 7 is effected by providing openings 11 in the band 3 through which moulding side cores may project during the moulding operation. These are commonly called "splits" to those trained in the art. As shown in the drawings we prefer to arrange the spaced apart lugs in diametrically opposed pairs and in the example shown there are two pairs of diametrically opposed small rounded lugs 6 and one pair of diametrically opposed large sharp lugs 7. It will be understood however, that the illustrated arrangement is only an example and if desired all the lugs may be the same arcuate size, some being sharp lugs and some being rounded lugs. We think that one pair of sharp lugs will be sufficient to achieve the desired object and in any case to provide more than two sharply defined lugs would unduly complicate the moulding operation and the design of the aforementioned "splits". Naturally, if desired there may be more than two pairs of small lugs or in some cases just one pair of small lugs may suffice. It should be mentioned that the drawings show by way of example the invention applied to one of our JAY-SAFE closures but it will be understood that the invention is applicable to any closure having a cap part and a tamper evident band connected to the cap part by frangible means. The closure may be a straight down snap on closure or a screw closure as shown in FIG. 1. An example of a snap on closure employing a similar principle is shown in our co-pending European Patent Application No. 84308232.2. As an example of a container body to which the improved closure embodying this invention may be applied reference is directed to FIGS. 5 and 6 which show the closure applied to a milk bottle.

Our improved closure is preferably moulded from any suitable plastics material that has sufficient resilient capability e.g. polypropylene and high density polyethylene and the closure may be applied to a container body of any desired material e.g. plastics material, glass, ceramic or metal, the essential requirement being the provision of an annular or substantially annular bead around the below the mouth for cooperation with the spaced apart lugs on the band. As indicated immediately above, in some cases it may be advantageous for the band on the body to be made up of arcuate sections instead of being a completely arcuate band. Preferably the closure has an aesthetically pleasing "smooth" or unbroken exterior surface. Most, if not all, existing closures have a "stepped" exterior which is relatively unacceptable in the market place and we are seeking to achieve the preferred shape by a different method.

Just as in our European Patent Application No. 82306203 referred to above we provide a closure 1 which has a cap part 2 and a tamper resistant band 3 connected to the cap part 2 by vertically arranged frangible tongues 5. The cap part 2 has a skirt 4 and a depending annular sealing projection to rest on a part of a container and an internal screw thread for cooperation with a screw thread on the container. The tamper resistant band has an internal bulbous annular bead for cooperation with an external bead on the container. The closure 1 also has pointed teeth on the upper edge of the tamper resistant band 3. In operation when the closure is applied to a threaded container the thread on the closure 1 engages with the thread on the container and as the closure is moved downwardly, turning on its vertical axis as it does so, the pointed teeth on the skirt 4 engage with the pointed teeth on the band 3 so that movement of the cap part 2 drives the band 3 around with it and the tongues 5 remain unbroken. The closure reaches its operative position when the internal bead on the band has passed over the external bead on the container. When the closure is removed the cap part moves upwards so that the teeth on the skirt move away from the teeth on the band and the frangible tongues break.

I claim:

1. A container closure and container body assembly in which the container body has a mouth and an external annular or substantially annular projecting bead around the outside of the body below the mouth and in which the closure comprises a cap part with a depending skirt and a safety band connected to the skirt by frangible means characterised in that the safety band is provided with at least four relatively short spaced apart rounded lugs projecting inwardly from the band and with a plurality of relatively long spaced apart lugs of sharp profile, also projecting inwardly from the band and arranged so as to comprise at least one diametrically opposed pair, the arrangement being such that the inwardly projecting lugs cooperate with the projecting bead on the container body to prevent initial removal of the cap part from the container body until the frangible means connecting the skirt of the cap part to the safety band has been broken.

2. An assembly according to claim 1 wherein the relatively short spaced apart lugs are all of the same size and shape.

3. An assembly according to claim 1 wherein two lugs of sharp profile are provided.

4. An assembly according to claim 1 wherein the band is connected to the cap part by frangible tongues.

5. An assembly according to claim 3 wherein the relatively long lugs have a substantially horizontal upper surface and an inclined lower cam surface.

6. An assembly according to claim 3 wherein openings are provided in the band through which moulding side cores may project.

7. An assembly according to claim 1 wherein the lugs are all arranged in diametrically opposed pairs.

8. A closure for a container body having a mouth and an external annular or substantially annular projecting bead around the outside of the body below the mouth wherein the closure has a cap part including a depending skirt and a safety band connected to the skirt by frangible means characterised in that the safety band is provided with at least four relatively short spaced apart rounded lugs projecting inwardly from the band and with a plurality of relatively long spaced apart lugs of sharp profile, also projecting inwardly from the band and arranged so as to comprise at least one diametrically opposed pair, the arrangement being such that the inwardly projecting lugs are adapted to cooperate with the projecting bead on the container body to prevent initial removal of the cap part from the container body until the frangible means connecting the skirt of the cap part to the safety band has been broken.

9. A closure according to claim 8 characterised in that the lugs are all arranged in diametrically opposed parts.

* * * * *